US006448207B1

(12) United States Patent
Fukutani et al.

(10) Patent No.: US 6,448,207 B1
(45) Date of Patent: Sep. 10, 2002

(54) METAL WORKING FLUID

(75) Inventors: Kikuko Fukutani, Kanzaki-Gun; Mie Tanaka, Omihachiman; Eiichiro Nakayama, Hikone; Yoshiki Ueno, Osaka; Shinya Fukushima, Echi-Gun; Kosuke Wada, Hikone; Shunji Suzuki, Yokkaichi, all of (JP)

(73) Assignees: Kikuko Fukutani, Shiga (JP); Mie Tanaka, Shiga (JP)

( * ) Notice: Subject to any disclaimer, the term of this patent is extended or adjusted under 35 U.S.C. 154(b) by 0 days.

(21) Appl. No.: 09/830,886

(22) PCT Filed: Oct. 5, 2000

(86) PCT No.: PCT/JP00/06975

§ 371 (c)(1),
(2), (4) Date: May 2, 2001

(87) PCT Pub. No.: WO01/25374

PCT Pub. Date: Apr. 12, 2001

(30) Foreign Application Priority Data

Oct. 6, 1999 (JP) ..... 11/285099

(51) Int. Cl.[7] ..... C10M 125/10; C10M 173/02

(52) U.S. Cl. ..... 508/175; 508/180; 508/539; 508/583

(58) Field of Search ..... 508/180, 539, 508/175; 72/42

(56) References Cited

U.S. PATENT DOCUMENTS

| | | | | | |
|---|---|---|---|---|---|
| 4,366,077 | A | * | 12/1982 | Andrew et al. | 72/42 |
| 5,356,544 | A | * | 10/1994 | Zilberman et al. | 508/539 |
| 5,484,541 | A | * | 1/1996 | Przybylski et al. | 508/539 |
| 5,580,845 | A | * | 12/1996 | Ruane | 508/161 |
| 5,624,888 | A | * | 4/1997 | Przybylski et al. | 508/161 |
| 6,242,391 | B1 | * | 6/2001 | Fukutani et al. | 508/180 |
| 6,258,759 | B1 | * | 7/2001 | Futahashi et al. | 508/143 |

FOREIGN PATENT DOCUMENTS

| | | | |
|---|---|---|---|
| JP | 57-44698 | * | 3/1982 |
| JP | 58-21489 | * | 2/1983 |
| JP | 8-60176 | * | 3/1996 |
| WO | WO00/49113 | * | 8/2000 |

* cited by examiner

*Primary Examiner*—Ellen M. McAvoy
(74) *Attorney, Agent, or Firm*—Milde & Hoffberg, LLP

(57) ABSTRACT

A metal working fluid, having excellent properties, contains a metal stearate, a carbonate, a hydrogencarbonate, and a surfactant. The metal working fluid may further contain ethyleneglycol and a rust inhibitor.

7 Claims, No Drawings

METAL WORKING FLUID

FIELD OF THE INVENTION

The present invention relates to a metal-working fluid. More particularly, the invention relates to a water soluble metal-working fluid, which can be used as a substitute for a cutting oil.

BACKGROUND OF THE INVENTION

Cutting metals such as iron, aluminum, and various types of alloys is one of the metal-working processes for removing unnecessary parts from a metal workpiece with the use of a cutting tool, which is widely used for providing a desired shape, size or surface to the metal workpiece.

In many cases of metal cutting work, enormous friction between a workpiece and a tool causes various problems such as frictional heat and thermal expansion. The frictional heat burns the tool and makes the surface of the workpiece rough, and the thermal expansion lowers the accuracy of the shape and the size of the workpiece and the tool. To overcome these problems, a cutting fluid or a lubricant has been employed in metal cutting.

A water-soluble or water-insoluble cutting oil is commonly used as a cutting fluid or lubricant. A typical example of a water-insoluble cutting oil is an oil solution comprising mineral oil as a base and sulfur and chlorine as additives. The disadvantage of the oil solution is that it can be used only when the cutting temperature is low because high cutting temperature may cause the production of fire and smoke. A water-soluble cutting oil is, for example, prepared by adding soap and sulfate as an emulsifier and higher alcohol and fatty acid ester as a binder to mineral oil and the like. Such water-soluble cutting oil is generally used after being diluted with water. A water-soluble cutting oil has an excellent lubricity, but on the other hand, it has low cooling property.

Both water-insoluble and water-soluble cutting oils can be used repeatedly in cutting operation. However, the bacteria propagates in cutting oils as time goes by, and therefore the cutting oil gives off an offensive odor by the bacteria itself or the gas produced by the bacteria. The disposal of used cutting oil has become the serious problem because the mineral oil and emulsifier contained therein exerts a negative influence on the environment when the oil is discharged as a waste liquid.

DISCLOSURE OF THE INVENTION

The present invention provides an environment-friendly metal-working fluid having excellent lubricity and cooling properties.

The metal working fluid of the present invention is an aqueous solution comprising metal stearate, carbonate, hydrogencarbonate, and surfactant.

The metal working fluid of the present invention may further comprise ethyleneglycol.

In the metal working fluid of the present invention, the metal stearate may be sodium stearate.

In the metal working fluid of the present invention, the carbonate may be sodium carbonate.

In the metal working fluid of the present invention, the hydrogencarbonate may be sodium hydrogencarbonate.

The metal working fluid of the present invention may further comprise a rust inhibitor.

The rust inhibitor may be an aqueous solution containing saturated fatty acid, ethylene diamine tetraacetato (EDTA) complex, tryltriazole, benzotriazole, and hydroxide.

The term "metal working" used herein refers broadly to metal cutting such as cutting with an edge tool, turning, drilling, planning and milling, and grinding with abrasive grain such as honing and lapping. It is also not limited in use to metal working, but may be used in rock drilling or the like.

One of the objects of the present invention is to provide a metal working fluid having an excellent lubricity and cooling property, which is capable of being mainly used to cut metals, preventing abrasion of a cutting tool, and extending the service life of a tool.

Another object of the present invention is to provide a metal working fluid, which can be used a number of times and does not contain environmentally hazardous substances.

DESCRIPTION OF THE PREFERRED EMBODYMENTS

A metal working fluid comprising a metal stearate, carbonate, hydrogencarbonate, and surfactant according to the present invention may have a pH value in the range from 7.5 to 10 under atmospheric pressure.

The metal working fluid of the present invention is an aqueous solution prepared by dissolving at least a metal stearate, carbonate, hydrogencarbonate, and surfactant in distilled water, deionized water, or tap water having a melting point of about 0° C., a boiling point of about 100° C., and a density of about 1.00 g/cm$^3$ at a temperature of 4° C.

The metal working fluid of the present invention may be prepared by further adding ethyleneglycol thereto. Although the metal stearate content, carbonate content, hydrogencarbonate content, surfactant content, and ethyleneglycol content are not particularly limited, the metal working fluid of the present invention preferably contains 0.05 to 0.5 wt % of metal stearate, 0.1 to 1 wt % of carbonate, 0.05 to 0.5 wt % of hydrogencarbonate, 0.1 to 2 wt % of ethyleneglycol, and 0.05 to 0.2 wt % of surfactant.

The metal stearate contained in the metal working fluid of the present invention is not particularly limited, but any metal stearate known to persons skilled in the art can be used. Examples of a preferable metal stearate are an alkali metal stearate such as lithium stearate, sodium stearate, potassium stearate, or rubidium stearate. The most preferable stearate is either sodium stearate or potassium stearate.

The carbonate contained in the metal working fluid of the present invention is not particularly limited, but any carbonate known to persons skilled in the art can be used. Examples of carbonate include potassium carbonate, calcium carbonate, and sodium carbonate. A preferable carbonate can be either sodium carbonate or potassium carbonate.

The hydrogencarbonate contained in the metal working fluid of the present invention is not particularly limited, but any hydrogencarbonate known to persons skilled in the art can be used. Examples of hydrogencarbonate used herein include potassium hydrogencarbonate, calcium hydrogencarbonate, and sodium hydrogencarbonate. A preferable hydrogencarbonate can be either sodium hydrogencarbonate or potassium hydrogencarbonate.

The surfactant contained in the metal working fluid of the present invention is not particularly limited, but any surfactant known to persons skilled in the art can be used.

The metal working fluid containing metal stearate, carbonate, hydrogencarbonate, surfactant, and ethyleneglycol can be used as a substitute for a conventional cutting oil. However, if the metal working fluid is left on them, a cutting tool and a workpiece can often be rusted. Therefore, a metal working fluid preferably contains a rust inhibitor. The rust inhibitor is not particularly limited, but any rust inhibitors known to persons skilled in the art can be used. Examples of the rust inhibitors include an ion coat type agent, paraffin wax, and carnauba wax. Preferably, a non-amine rust inhibitor is used to prepare a metal working fluid which does not adversely affect the environment. Examples of the non-amine rust inhibitor are aqueous solutions containing BTA (benzotriazole), TTA (thenoyltrifluoroacetone), methylbenzotriazole, and the like. A metal working fluid may further contain saturated fatty acid, dibasic acid, hydroxide, and EDTA complex to enhance rust-preventive effect. Examples of saturated fatty acid include caproic acid, caprylic acid, decanoic acid, lauric acid, myristic acid, palmitic acid, and stearic acid, and thus any saturated fatty acid known to persons skilled in the art can be used. Examples of the dibasic acid salt include dodecanoic diacid and sebacic acid.

In addition, a metal working fluid of the present invention may further contain a pH adjuster and a pH stabilizer.

Examples of a cutting tool to be used in metal cutting with a metal working fluid of the present invention include single-point tools such as a bite, multiple-point tools such as a drill, reamer, milling cutter, broach, saw and shank, and formed tool whose cutting edge is the same shape as a specific outline of a product. Examples of materials of a cutting tool include carbon tool steel, high-speed steel, cast nonferrous alloys, sintered carbides, sintered oxides, diamonds, artificial grindstone and the like.

Examples of a workpiece to be cut using a metal working fluid of the present invention include bar steels such as a round bar, a square bar and a hexagonal bar steel, and steel plates. More specifically, examples of the workpiece include a structural rolled steel for welding, a carbon steel, a molybdenum steel plate, a round bar for rivet, a round bar for chain, a rolled steel for welding, a carbon steel tube for machine structural use, but the workpiece to be cut is not limited by the above.

A metal working fluid of the present invention can prevent heat damage to a cutting tool, destruction of a cutting blade, and increasing abrasion of a cutting blade.

For example, a metal working fluid of the present invention may be supplied to a pump of a circular sawing machine, a bench drilling machine, a turning machine, or the like and can be used to cut and drill a round bar and to produce a flange surface.

The metal working fluid of the present invention has a lower viscosity than conventional cutting oils, so that smooth liquid flow and excellent circulation in a pump can be insured. Moreover, a metal working fluid of the present invention has an excellent lubricity and cooling property, which can prevent frictional heat from being produced between a tool and a workpiece, so that the effective tool life can be increased. In addition, the metal working fluid of the present invention can prevent bite traces from being left on the flange surface of a workpiece, so that the workpiece is finished nicely in appearance.

The metal working fluid of the present invention will be more clearly understood by referring to the Examples below. However, the Examples should not be construed to limit the invention in any way. It will be apparent to those skilled in the art that various improvements, changes ,and modifications can be made thereto without departing from the spirit or scope of the present invention.

EXAMPLES

Next, a method for producing a metal working fluid of the present invention and examples of a cutting process using the fluid will be hereinafter described. In the following Examples, the mark "%" represents "wt %" unless otherwise specified.

Example 1

A metal working fluid of the present invention was prepared as follows. First, 1 g of sodium stearate (a product of Wako Pure Chemicals Industries, Ltd.), 2.2 g of sodium carbonate (a product of Wako Pure Chemicals Industries, Ltd.), 1 g of sodium hydrogencarbonate (a product of Wako Pure Chemicals Industries, Ltd.), 0.7 cc (specific gravity of 1.072 g/ml) of Triton X-100 (a product of Yoneyama Kagaku Kogyo Kaisha, Ltd.), and 10 cc (specific gravity of 1.114 g/ml) of ethyleneglycol (a product of Wako Pure Chemicals Industries, Ltd.) were added to 975 cc of distilled water 0.15 g of aqueous solution was prepared by adding the resultant mixture to 3 g of caprylic acid (a product of NOF Corporation), 3.39 g of potassium hydroxide, 0.45 g of tetrasodium salt of ethylenediamine tetraacetate acid (EDTA-4Na; a product of Teikoku Chemical Industries CO., Ltd.), 0.9 g of dodecanoic diacid (a product of Okamura Chemical Co., Ltd.), 0.15 g of benzotriazole (a product of Johoku Chemical Co., Ltd) and distilled water. Thus, a metal working fluid having a pH value of 10.5 was prepared.

Example 2

The metal working fluid obtained in Example 1 was supplied to a tapping machine "TV-400" (a product of Mori Seiki Co., Ltd.). A steel sheet SS400 (Japanese Industrial Standard) was positioned on a table of the machine to drill holes therein by a drill, to chamfer the holes, and to cut threads into the holes by a tap. The drill used herein was OSG EX-SUS-GDS having a diameter of 2.6 mm. Drilling was carried out at a rotary speed of 3,186 rpm and at the feed rate of 320 mm per minute, and 2200 rough holes having a depth of 8 cm were obtained. The tap used herein was OSG EX-SUS-SFT M 3×0.5. Tapping was carried out at a rotary speed of 1700 rpm and at a feed rate of 0.5 mm per minute, and 1800 threads having a depth of 5 cm were obtained.

Example 3

The metal working fluid obtained in Example 1 was supplied to the tapping machine "TV-400" (a product of Mori Seiki Co., Ltd.). An aluminum sheet #3000 was positioned on the table of the machine to drill holes therein by a drill, to chamfer the holes, and to cut threads into the holes by a tap. The drill used herein was OSG EX-SUS-GDS having a diameter of 2.6 mm. Drilling was carried out at a rotary speed of 7,000 rpm and at the feed rate of 1030 mm per minute, and 1260 rough holes having a depth of 8 cm were obtained. The tap used herein was OSG EX-SUS-SET M3×0.5. Tapping was carried out at a rotary speed of 2330 rpm and at a feed rate of 0.5 mm per minute, and 1150 threads having a depth of 5 cm were obtained.

Example 4

The metal working fluid obtained in Example 1 was supplied to the tapping machine "TV-400" (a product of Mori Seiki Co., Ltd.). A stainless steel sheet SUS304 (Japanese Industrial Standard) was positioned on the table of the machine to drill holes therein by a drill, to chamfer the holes, and to cut threads into the holes by a tap. The drill used herein was OSG EX-SUS-GDS having a diameter of 2.6 mm. Drilling was carried out at a rotary speed of 19,100 rpm and at the feed rate of 130 mm per minute, and 845 rough holes having a depth of 8 cm were obtained. The tap used herein was OSG EX-SUS-SFT M 3×0.5. Tapping was carried out at a rotary speed of 1170 rpm and at a feed rate of 0.5 mm per minute, and 636 threads having a depth of 5 cm were obtained.

The metal working fluid of the present invention has been already used for production of semiconductors, plant equipment, and auto parts in some companies. Specifically, a metal working fluid of the present invention has been used in the Japanese Mint Bureau in Ikebukuro, Tokyo, for production of medals; in TOYOTA MOTOR CORP. and its Research and Development Center, HONDA MOTOR CO., LTD., NISSAN MOTOR CO., LTD., and SUZUKI MOTOR CORP. for production of auto parts; in Research and Development Center of TOSHIBA CORPORATION for production of semiconductors; in Nippon Steel Corporation for production of plant equipment; in TOPY INDUSTRIES, LTD. for production of parts of a bulldozer; in Komatsu Manufacturing Co., Ltd. for production of parts of bulldozer; in AISIN SEIKI CO.,LTD. for production of auto parts; in Machining Center of Ritsumeikan University for research; and in Kirin Brewery Co., Ltd. for cutting piping. For example, when a semiconductor part is produced using a conventional oil, the oil was left in micron diameter holes of the semiconductor device. The oil was heated in a drying process to generate organic gases, which degraded the quality of a product. However, the metal working fluid of the present invention is evaporated in a drying process, so that the quality of a product can be maintained. In addition, when a zinc-plated steel roll and a stainless steel roll are worked, a metal working fluid of the present invention could protect these metal rolls from white mold development, which could not have been prevented by conventional oil.

INDUSTRIAL APPLICABILITY

The metal working fluid according to the present invention can be used as a substitute for a conventional cutting oil. The metal working fluid has a low viscosity, excellent liquid flow in a pump, excellent lubricity and cooling property. Therefore, the metal working fluid of the present invention increases the useful life of a cutting tool and improves the operation efficiency. Moreover, liquid wastes of the metal working fluid do not include any environmentally hazardous substances.

The metal working fluid of the present invention can also be used as a rust inhibitor when a non-amine rust inhibitor is added thereto. In this case, the fluid does not adversely affect the environment.

What is claimed is:

1. A metal working fluid being an aqueous solution comprising:

water;

metal stearate;

carbonate;

hydrogencarbonate; and surfactant.

2. The metal working fluid according to claim 1, further comprising ethyleneglycol.

3. The metal working fluid according to claim 2, comprising:

0.05 to 0.5 wt % of said metal stearate;

0.1 to 1 wt % of carbonate;

0.05 to 0.2 wt % of said hydrogencarbonate;

0.05 to 0.2 wt % of said surfactant; and 1 to 2 wt % of ethyleneglycol.

4. The metal working according to claim 1, wherein said metal stearate is sodium stearate;

said carbonate is sodium carbonate; and said hydrogencarbonate is sodium hydrogencarbonate.

5. The metal working fluid according to claim 1, further comprising a rust inhibitor.

6. The metal working fluid according to claim 5, wherein id rust inhibitor contains saturated fatty acid, dibasic acid, hylene diamine tetraacetate complex, tryltriazole, zotriazole, and hydroxide.

7. The metal working fluid according to claim 1, wherein said metal working fluid is usable as a cutting fluid.

* * * * *